US007528796B2

(12) United States Patent
Leisten

(10) Patent No.: US 7,528,796 B2
(45) Date of Patent: May 5, 2009

(54) ANTENNA SYSTEM

(75) Inventor: Oliver Paul Leisten, Raunds (GB)

(73) Assignee: Sarantel Limited, Wellingborough (GB)

( * ) Notice: Subject to any disclaimer, the term of this patent is extended or adjusted under 35 U.S.C. 154(b) by 183 days.

(21) Appl. No.: 11/803,405

(22) Filed: May 10, 2007

(65) Prior Publication Data

US 2008/0036689 A1 Feb. 14, 2008

Related U.S. Application Data

(60) Provisional application No. 60/831,334, filed on Jul. 17, 2006.

(30) Foreign Application Priority Data

May 12, 2006 (GB) ..... 0609518.6

(51) Int. Cl.
*H01Q 1/36* (2006.01)

(52) U.S. Cl. ..... 343/895

(58) Field of Classification Search ..... 343/895, 343/702

See application file for complete search history.

(56) References Cited

U.S. PATENT DOCUMENTS 3,599,220 A 8/1971 Dempsey
4,008,479 A 2/1977 Smith
4,114,164 A * 9/1978 Greiser ..... 343/895
4,554,554 A 11/1985 Olesen et al.
4,608,574 A 8/1986 Webster et al.
4,658,262 A * 4/1987 DuHamel ..... 343/792.5
5,191,352 A 3/1993 Branson
5,346,300 A 9/1994 Yamamoto et al.
5,349,365 A 9/1994 Ow et al.
5,594,461 A * 1/1997 O'Neill, Jr. ..... 343/895
5,635,945 A 6/1997 McConnell et al.
5,706,019 A * 1/1998 Darden et al. ..... 343/895
5,838,282 A 11/1998 Lalezari et al.
5,854,608 A * 12/1998 Leisten ..... 343/895
5,854,609 A 12/1998 Pyo et al.
5,859,621 A * 1/1999 Leisten ..... 343/895
5,945,963 A 8/1999 Leisten
5,963,180 A 10/1999 Leisten
6,011,524 A 1/2000 Jervis (Continued)

FOREIGN PATENT DOCUMENTS

CN 94203005 2/2005

(Continued)

*Primary Examiner*—Tho G Phan
(74) *Attorney, Agent, or Firm*—John Bruckner, PC

(57) ABSTRACT

An antenna system for operation at frequencies in excess of 200 MHz, comprises an antenna, a transmission line and a receiver stage, the transmission line electrically connecting the antenna to an input of the receiver stage, and the antenna having: an antenna core of a solid insulative material having a relative dielectric constant greater than 5, the material of the core occupying the major part of the volume defined by the core outer surface, and a three-dimensional antenna element structure disposed on or adjacent the outer surface of the core; wherein the antenna is fed by the transmission line at a proximal end of the dielectric core; the receiver stage comprises an amplifier and an electromagnetic radiation screen, the amplifier being positioned within the screen; and the transmission line includes a current choke arranged to provide a substantially balanced condition at a feed connection of the antenna.

24 Claims, 3 Drawing Sheets

U.S. PATENT DOCUMENTS

| | | | | |
|---|---|---|---|---|
| 6,031,495 | A | 2/2000 | Simmons et al. | |
| 6,094,178 | A | 7/2000 | Sanford | |
| 6,133,891 | A | 10/2000 | Josypenko | |
| 6,150,984 | A | 11/2000 | Suguro et al. | |
| 6,229,488 | B1 | 5/2001 | Lin et al. | |
| 6,229,499 | B1 | 5/2001 | Licul et al. | |
| 6,232,929 | B1 | 5/2001 | Ermutlu et al. | |
| 6,300,917 | B1 | 10/2001 | Leisten et al. | |
| 6,369,776 | B1 | 4/2002 | Leisten et al. | |
| 6,384,798 | B1 | 5/2002 | Barta et al. | |
| 6,476,776 | B1 | 11/2002 | Kurby | |
| 6,480,173 | B1 | 11/2002 | Marino | |
| 6,552,693 | B1 | 4/2003 | Leisten | |
| 6,690,336 | B1 | 2/2004 | Leisten et al. | |
| 6,765,541 | B1 | 7/2004 | Josypenko | |
| 6,821,859 | B2 | 11/2004 | Raebiger et al. | |
| 6,886,237 | B2 | 5/2005 | Leisten et al. | |
| 6,914,580 | B2 | 7/2005 | Leisten | |
| 7,256,752 | B2 | 8/2007 | Wither et al. | |
| 7,408,515 | B2 * | 8/2008 | Leisten | 343/702 |
| 2002/0113731 | A1 | 8/2002 | Strickland | |
| 2006/0067119 | A1 | 3/2006 | Tempel | |

FOREIGN PATENT DOCUMENTS

| | | | |
|---|---|---|---|
| CN | 2899134 | Y | 5/2007 |
| EP | 0469741 | | 2/1992 |
| EP | 0528175 | A | 2/1993 |
| EP | 1076378 | | 2/2001 |
| EP | 1306921 | A | 5/2003 |
| GB | 587627 | A | 5/1947 |
| GB | 2202638 | | 9/1988 |
| GB | 2282487 | A | 4/1995 |
| GB | 2292257 | | 2/1996 |
| GB | 2292638 | A | 2/1996 |
| GB | 2310543 | A | 8/1997 |
| GB | 2311675 | | 10/1997 |
| GB | 2338605 | A | 12/1999 |
| GB | 2351850 | A | 1/2001 |
| GB | 2367429 | A | 4/2002 |
| GB | 2424521 | | 9/2006 |
| GB | 2419037 | A | 4/2008 |
| JP | 02278901 | | 11/1990 |
| TW | 1238566 | | 7/1993 |
| TW | 1248230 | | 1/2006 |
| WO | WO 99/26316 | | 5/1999 |
| WO | WO 99/31820 | | 6/1999 |
| WO | WO0048268 | | 8/2000 |
| WO | WO03044895 | | 5/2003 |
| WO | WO2006/136810 | | 12/2006 |
| WO | WO2006136809 | | 12/2006 |

* cited by examiner

ANTENNA SYSTEM

CROSS-REFERENCE(S) TO RELATED APPLICATION(S)

This application is related to, and claims a benefit of priority under one or more of 35 U.S.C. 119(a)-119(d) from copending foreign patent application 0609518.6, filed in the United Kingdom on May 12, 2006 under the Paris Convention, the entire contents of which are hereby expressly incorporated herein by reference for all purposes. This application claims a benefit of priority under 35 U.S.C. 119(e) from copending provisional patent application U.S. Ser. No. 60/831,334, filed Jul. 17, 2006, the entire contents of which are hereby expressly incorporated herein by reference for all purposes.

BACKGROUND INFORMATION

1. Field of the Invention

This invention relates to an antenna system for operation at frequencies in excess of 200 MHz, and particularly, but not exclusively, to an antenna system comprising an antenna having helical elements on or adjacent the surface of a dielectric core for receiving circularly polarised signals.

2. Discussion of the Related Art

U.S. Pat. No. 7,002,530 discloses a cylindrical dielectric-loaded antenna having a plurality of helical elements arranged on the outer cylindrical surface of a dielectric core. The helices are connected to each other at a distal end of the dielectric core by a link conductor which is arranged around the circumference of the distal end of the core. At a proximal end of the core, the helical antenna elements are connected to a pair of conductors, positioned on a circuit board mounted to the proximal end of the core. The circuit board comprises a phase splitting circuit which produces a single-ended output. The antenna elements being fed at the proximal end of the antenna, this antenna is an "end-fire" antenna.

In many mobile telecommunication applications, common-mode conducted noise interference can be a significant problem due to high-power interference sources. For example, in mobile telephone applications, planar inverted-F antennas (PIFAs) stimulate large currents in the ground plane. This problem is exacerbated by the fact that designers often want the board to radiate and the ground-plane is often placed on the top layer of a circuit board. Therefore, if a received signal is provided from a single-ended output, as an input to an amplifier, the amplifier will amplify common-mode noise signals present on the ground plane of the device in which the antenna is mounted. The amplified signal will therefore be distorted by common-mode noise.

United Kingdom Patent No. 2292638, in the name of the Applicant, discloses a further example of a dielectric-loaded helical antenna. The antenna has a plurality of helical antenna elements arranged on the cylindrical surface of the dielectric core. The helical antenna elements are fed at the distal end of the dielectric core by a feeder structure which is arranged along the axis of the dielectric core. As such, the antenna is a "backfire" antenna. The antenna also has a conductive sleeve formed on a proximal end portion of the dielectric core and which performs the function of a balun trap. The balun converts unbalanced signals at the proximal end of the antenna to balanced signals at the distal end of the antenna. The main advantages of this antenna are good isolation from the structures in which it is mounted and improved radiation patterns. The balun trap on the proximal end of the core of the dielectric isolates the antenna elements from the transmission line, preventing common-mode noise signals interfering with the amplification circuitry. The antenna is coupled to a short length of shielded transmission line such as a coaxial cable. Common-mode noise currents conducted along the outer sleeve of the coaxial cable are choked by the balun trap, preventing them entering the coaxial cable at its connection with the antenna proximal end.

SUMMARY OF THE INVENTION

It is an object of the present invention to provide an alternative antenna system with common-mode noise rejection capabilities.

According to a first aspect of this invention, an antenna system for operation at frequencies in excess of 200 MHz, comprises an antenna, a transmission line and a receiver stage, the transmission line electrically connecting the antenna to an input of the receiver stage, and the antenna having: an antenna core of a solid insulative material having a relative dielectric constant greater than 5, the material of the core occupying the major part of the volume defined by the core outer surface, and a three-dimensional antenna element structure disposed on or adjacent the outer surface of the core; wherein the antenna is fed by the transmission line at a proximal end of the dielectric core, the receiver stage comprises an amplifier and an electromagnetic radiation screen, the amplifier being positioned within the screen, and the transmission line includes a current choke arranged to provide a substantially balanced condition at a feed connection of the antenna.

Typically, the antenna element structure comprises a plurality of antenna elements, located on the outer surface of the core, which is preferably a cylinder. In particular, the antenna elements may comprise metallic conductor tracks bonded to the core outer surface, for example by deposition or by etching of a previously applied metallic coating. The cylindrical core is typically made of solid material with an axial extent at least as great as its outer diameter.

For reasons of physical and electrical stability, the material of the core may be ceramic, e.g. a microwave ceramic material such as a zirconium-titanate-based material, magnesium calcium titanate, barium zirconium tantalate, and barium neodymium titanate, or a combination of these. The preferred relative dielectric constant is upwards of 10 or, indeed, 20, with a figure of 36 being attainable using zirconium-titanate-based material. Such materials have negligible dielectric loss to the extent that the Q of the antenna is governed more by the electrical resistance of the antenna elements than core loss.

In a particularly preferred embodiment of the invention, the antenna elements are generally helical and are generally co-extensive in an axial direction. Each helical element is connected at one end to a feeder structure at a proximal end of the core via a plurality of radial elements located on the proximal end surface of the core. The other ends of the helical elements are connected to a link conductor on the outer cylindrical surface of the dielectric core, towards the distal end of the core. The radial elements are electrically connected to a conductor of the transmission line. In this manner, the helical elements and link conductor form at least one loop. Preferably, the antenna comprises four helical elements, each antenna element being coupled to a respective radial element. The radial elements are arranged to form two pairs, the radial elements of each pair being electrically interconnected. Each pair is connected to a conductor of the transmission line.

The longitudinally extending helical antenna elements may be of different electrical lengths. In particular, in the case of a preferred antenna having four helical elements, two of the elements are of a greater electrical length than the other two by virtue of following meandering paths on the outer surface of the core or being of greater thickness. In the case of an antenna for circularly polarised signals, all four elements follow a generally helical path, the two helical elements arranged on opposing sides of the core following meandering paths.

The helical elements form part of a radiating element structure. The phrase "radiating element structure" is used in the sense understood by those skilled in the art, that is to mean elements which do not necessarily radiate energy as they would when connected to a transmitter, and to mean therefore, elements which either collect or radiate electromagnetic radiation energy. Accordingly, the antenna system which is the subject of this specification may be used in apparatus which only receives signals, as well as in apparatus which both transmits and receives signals.

In a preferred embodiment, a first conductor of the transmission line is connected between (a) a first pair of radial elements of the antenna element structure and (b) the receiving circuit, which is located within the electromagnetic screen. The first conductor is electrically insulated from the screen and the ground plane, and is electrically coupled to the receiving circuit and the first pair of radial elements only. A second conductor of the transmission line is connected between a second pair of the radial elements and the screen. There is no intermediate coupling of the second conductor to ground between the antenna and the receiver stage.

Advantageously, the transmission line is formed from conductive tracks of multi-layer circuit board. The first conductor of the transmission line is formed as a middle layer of the circuit board and the second conductor is arranged as an upper conductive layer of the board. These conductors are longitudinally co-extensive and preferably extend axially from the antenna in the case of an antenna having a cylindrical core. The second conductor is preferably wider than the first conductor and in particular may be at least twice as wide. Insulative material of the multi-layer circuit board acts as the dielectric core of the transmission line. Preferably, a third conductor is arranged as a lower conductive layer of the multi-layer circuit board and is co-extensive with the second conductor, the first conductor being screened by the second and third conductors above and below it. The transmission line is coupled to the receiving circuit and terminates within the electromagnetic screen. Where the transmission line passes through the electromagnetic screen, the second conductor and, when present, the third conductor, are preferably coupled to the screen. The first conductor is insulated from the screen by the insulative material of the multi-layer board and is coupled to the receiving circuit. Interconnections such as plated holes ('vias') are preferably provided along the longitudinal edges of the second and third transmission line conductors to interconnect them on either side of the first conductor to provide a better screen for the latter.

In a preferred embodiment, the current choke is arranged in the region of the transmission line between the electromagnetic screen and the antenna. The current choke is preferably a sleeve balun, extending over part of the length of the transmission line. The sleeve balun typically comprises at least one conductive plate arranged in parallel with the conductors of the transmission line and separated from the second conductor by a layer of dielectric material which may be substantially the same thickness as the material separating the first and second conductors. The conductive plate is substantially the same width as the second and third conductors and its length is such that, in combination with the insulative layer between it and the transmission line conductor, it has an electrical length of a quarter wavelength at the operating frequency of the antenna system, or an odd multiple of the quarter wavelength. At the end of the transmission line near the electromagnetic screen, the first plate is electrically coupled to the second conductor.

At its edge nearest the antenna, the first plate is not electrically coupled to the second conductor. A second conductive plate may be arranged in the same manner on the opposing surface of the multi-layer circuit board. Preferably, the plates and the dielectric material separating the plates from the second and third conductors are formed as outer layers of the multi-layer circuit board. Connections to the second and third conductors may each be made by a line of vias along the edge of the respective balun plate nearest to the receiver stage. Alternative dielectric-loaded quarter wave open circuit structures may be used.

The current choke isolates the antenna from the transmission line and prevents common-mode noise signals entering the transmission line at the feed connection with the antenna. The current choke also prevents common-mode noise signals propagating along the outer surface of the screen from travelling along the second and third conductors and onto the antenna. In this manner, common-mode noise interference with the antenna signals is largely avoided.

Reference in this specification to "radiation" or elements "radiating" are to be construed on the basis that, in an antenna used solely for receiving signals, these terms refer to the reciprocal effect in which incident electromagnet radiation is converted to electrical currents in such elements. Were the receiving antenna to be coupled to a transmitter radiation would occur and the elements referred to would be radiating elements.

The balun prevents the transmission line acting as a radiating element.

BRIEF DESCRIPTION OF THE DRAWINGS

The invention will now be described by way of example and with reference to the accompanying drawings in which.

DESCRIPTION OF PREFERRED EMBODIMENTS

Figure 1:
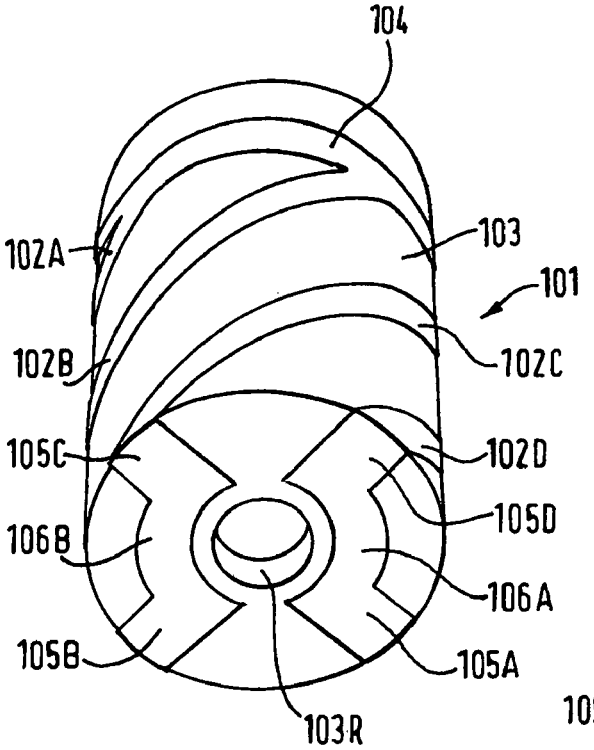
FIG. 1 is a perspective view of an antenna forming part of an antenna system in accordance with the invention.

Referring to FIG. 1, a quadrifilar antenna 101 has an antenna element structure with four longitudinally extending helical antenna elements 102A, 102B, 102C and 102D, formed as plated metallic conductor tracks on the cylindrical outer surface of a ceramic core 103. An annular link conductor 104, positioned on the outer surface of the core, connects the antenna elements adjacent a distal end of the antenna. At a proximal end of the antenna, four radial elements 105A, 105B, 105C and 105D, formed as metallic tracks, are plated on the end surface of the core. Each radial element is electrically connected to a respective antenna element. The radial elements are connected to a transmission line feed structure, as described in more detail below with reference to FIGS. 2 and 4. In this embodiment of the invention, the antenna is an "end-fire" antenna for receiving circularly polarised radiation, the helical elements being connected to the feed structure at the proximal end.

The antenna has a main resonant frequency of 500 MHz or greater, its resonant frequency being determined by the effective electrical lengths of the antenna elements. The electrical lengths of the elements, for a given frequency of resonance, are dependent on their physical lengths, and also on their widths and on the relative dielectric constant of the core material, the dimensions of the antenna being substantially reduced with respect to an air-cored similarly constructed antenna.

The preferred material for the core 103 is zirconium-titanate-based material. This material has a relative dielectric constant of 36 and is noted also for its dimensional and electrical stability with varying temperature. Dielectric loss is negligible. The core may be produced by extrusion or pressing.

The antenna elements 102A-102D and radial elements 105A-105D are metallic conductor tracks bonded to the outer cylindrical and end surfaces of the core 103. The antenna elements 102A-102D are at least four times wider than they are thick over the operative length. The tracks may be formed by initially plating the surfaces of the core 103 with a metallic layer and then selectively etching away the layer to expose the core according to a pattern applied in a photographic layer similar to that used for etching printed circuit boards. Alternatively, the metallic material may be applied by selective deposition or by printing techniques. In all cases, the formation of the tracks as an integral layer on the outside of a dimensionally stable core leads to an antenna having dimensionally stable antenna elements.

Figure 2:
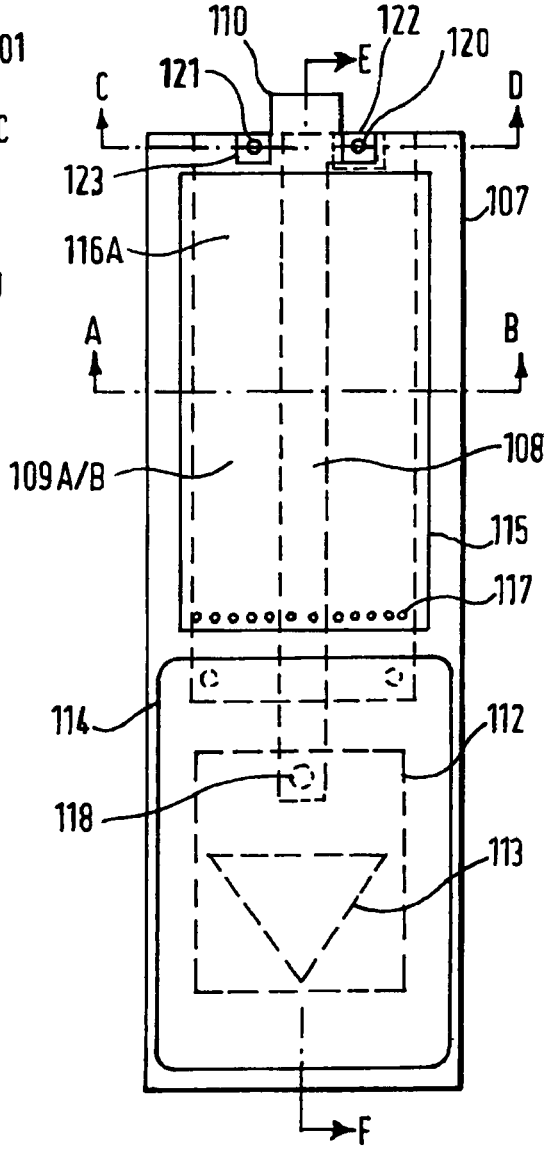
FIG. 2 is a diagrammatic view of the antenna system not showing the antenna.

Referring to FIG. 2, mounted to the proximal end of the antenna is a printed circuit board 107, for example, a multiple layer printed circuit board (PCB). Multiple layer circuit boards typically use a number of layers of insulative material. Different materials may be used for different insulative layers. Conductive tracks are formed between the layers, and on the surfaces of the outer layers, of the board. This board has an inner conductor 108, indicated by dotted lines, and outer shield conductors 109A and 109B, as can be seen more clearly in FIGS. 3 and 4. FIG. 4 is a view of the proximal end of the antenna, showing the antenna mounted to the PCB 107, the PCB being sectioned on the line AB appearing in FIG. 2. The proximal end of the antenna has four radial elements 105A, 105B, 105C and 105D which are each connected to a respective one of the antenna elements 102A, 102B, 102C and 102D. The radial elements are interconnected to form two pairs arcuate by connecting elements 106A and 106B. The board 107 is positioned diametrically across the proximal end of the antenna. The core of the antenna has a recess 103R in its proximal end into which a tab 110 of the board (see FIG. 2) extends in order to hold the antenna in place. The recess 103R may be a blind recess, as shown, of a depth corresponding to the length of the tab 110, or it may extend through the core 103. At the join between the board and the antenna, the inner conductor is electrically connected to connecting element 106A. The outer conductors 109A and 109B are both connected to the connecting element 106B at the join between the board and antenna. Thus, the inner and outer conductors of the board form a transmission line feeder for the loop antenna 101.

As can be seen in FIG. 2, the board 107 is a rectangular multilayer circuit board, of substantially the same width as the antenna. The inner conductor 108 comprises an elongate track arranged lengthwise of the board and is also substantially rectangular, except for extensions at the respective ends of the inner conductor suitable for coupling the transmission line to the antenna and the receiving circuit. The inner conductor 108 is narrower than the circuit board 107 and the insulative layers of the PCB therefore extend further than the inner conductor on either side of the inner conductor. The outer conductors 109A and 109B are arranged to cover substantially all of the rectangular circuit board between the antenna and the receiving circuit. Thus, the outer conductors also extend further than the inner conductor, on either side of the inner conductor. The circuit board may form part of a larger circuit board which forms part of the device into which the antenna system is placed.

Figure 7:
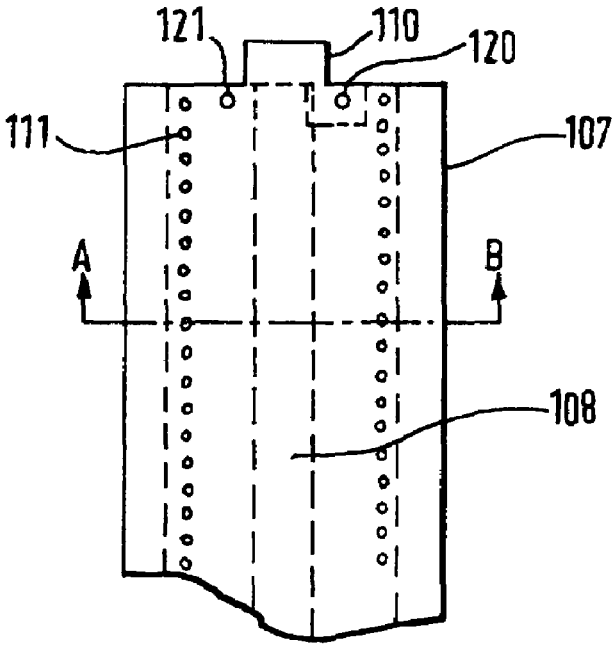
FIG. 7 is a diagrammatic cutaway plan view of a transmission line forming part of the antenna system of FIG. 2.

Referring to FIG. 7, a plurality of vias 111 are formed between the outer conductors. The outer conductors have arranged therebetween at least two layers of insulative circuit board. A via is a hole formed in the circuit board having a conductive coating on its inner surfaces. It therefore electrically connects conductors on opposing surfaces of the circuit board. In FIG. 7 it can be seen that the vias are formed along the longitudinal edges of the circuit board, where the outer conductors extend beyond the inner conductor. In this manner, the outer conductors are electrically interconnected to form a shield for the inner conductor, which remains electrically isolated from the outer conductors. This arrangement prevents the transmission line acting as a radiating element. Only the conductors plated on the antenna core radiate.

Figure 3:
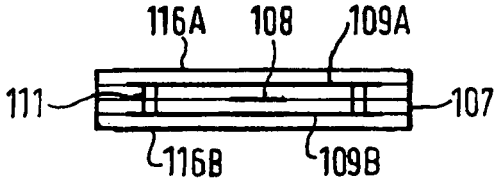
FIG. 3 is a diagrammatic cross-sectional view on the line AB in FIGS. 2 and 7.
Figure 4:
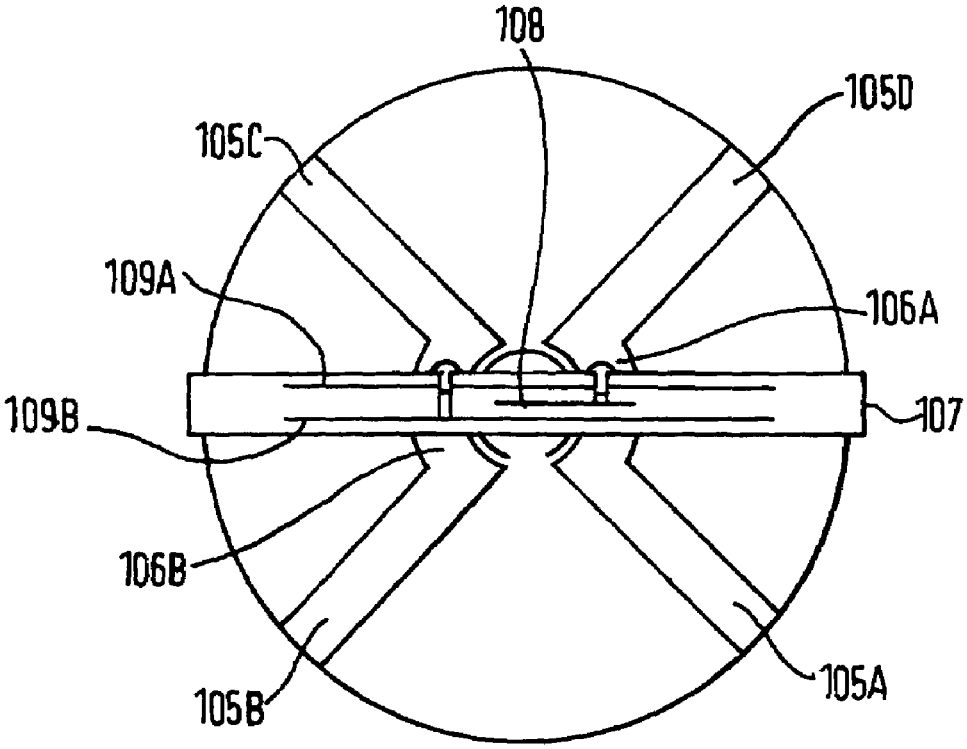
FIG. 4 is a diagrammatic cross-sectional view on the line CD in FIG. 2, also showing a proximal end of the antenna.

Referring to FIG. 3, which is a cross-section through AB (FIG. 2), the inner conductor 108 and outer conductors 109A and 109B are shown as conductive tracks sandwiched between the insulative layers of the multi-layer circuit board 107. Also shown are the vias 111 electrically interconnecting the outer conductors 109A and 109B.

Figure 5:
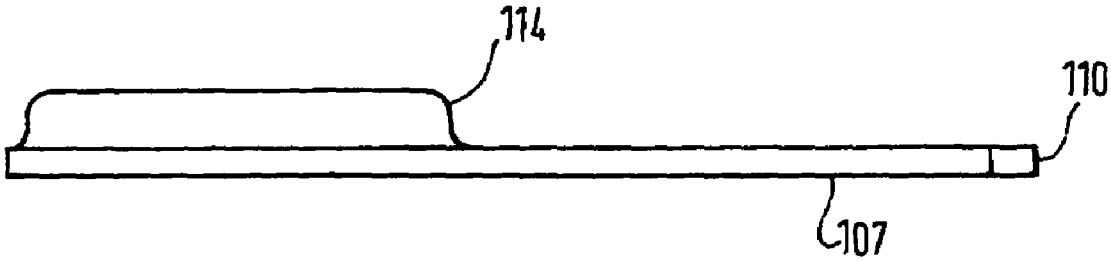
FIG. 5 is a diagrammatic side view of the antenna system of FIG. 2 not showing the antenna.

Referring again to FIG. 2, the inner and outer conductors are coupled to a receiving circuit 112, comprising at least one amplifier 113, which is arranged within a screen or Faraday cage 114. The screen 114 appears in side elevation in FIG. 5. The outer conductors are electrically connected the Faraday cage which is, in turn, electrically connected to the ground terminal of the amplifier. The inner conductor terminates inside the Faraday cage and is coupled to the amplifier. Consequently, the only connection of the antenna to ground is by way the transmission line outer conductors 109A, 109B and their ground connection at the receiver circuitry input. There is no other connection to ground between the antenna and the amplifier.

Figure 6:
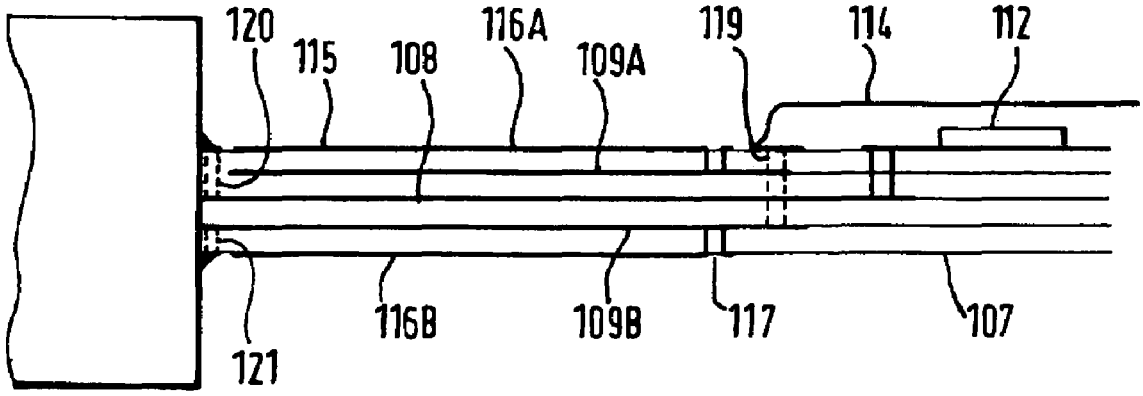
FIG. 6 is a diagrammatic cross-sectional side view of the antenna along the line EF in FIG. 2.

The inner conductor 108 is electrically connected to the receiving circuit 112 by a via 118 and the outer conductors 109A and 109B are electrically connected to the ground plane of the receiving circuit by via 119 as can be seen in FIG. 6. At the end of the printed circuit board near the antenna, the inner conductor is electrically connected to a conductive pad 122 on the outer surface of the board 107 by a via 120 and the outer conductor is electrically connected to another conductive pad 123 on the outer surface by a via 121, as can be seen in FIG. 2. The pads 122, 123 allow connection to the conductive tracks on the proximal face of the antenna.

A current choke is placed between the receiving circuit and the antenna to reduce superimposition of common-mode noise on the antenna signals and to prevent the transmission line outer conductors acting as part of the structure receiving electromagnetic radiation from the surroundings. The current choke is in the form of a sleeve balun 115, as can be seen in FIG. 2. FIG. 6 is a cross-sectional side view of the sleeve balun 115 in place on the board 107. The sleeve balun comprises a pair of conductive plates 116A, 116B, each overlying a respective one of the outer conductive layers 109A, 109B of the transmission line, and connecting at an edge, preferably an edge furthest from the antenna, to the respective outer conductive layer 109A, 109B. The balun plates 116A, 116B are preferably electrically connected with the outer conductors 109A, 109B using a plurality of vias 117, as can be seen in FIGS. 2 and 6. Between each sleeve balun plate 116A, 116B and the underlying outer conductive layer of the transmission line is a dielectric layer. In the preferred embodiment this layer forms part of the PCB, and is typically composed of a ceramic-loaded plastics material having a relative dielectric constant, $\in_r$, of about 4. FR-4 is an example of such a material. Its relative dielectric constant is 4.7. The electrical length of each sleeve balun plate is a quarter wavelength at the operating frequency of the antenna, in terms of the extent of the plate from its edge connected to the underlying conductive layer and the opposite edge. At an antenna operating frequency of 1575 MHz, using FR-4 board, the length of the sleeve balun is be approximately 2 cm. This balun operates in a manner which is familiar to a person skilled in the art. Any part of the transmission line exposed between the sleeve balun and the antenna will radiate. Therefore, the balun is positioned as close to the antenna as possible, as can be seen in FIG. 2.

This arrangement has several benefits. Firstly, the balun chokes currents on the outer conductors, thereby preventing any common-mode noise signals (generated, e.g., by other circuits in the equipment in which the antenna is mounted) flowing off the Faraday cage and entering the transmission line. In this manner the balun screens the transmission line from common-mode noise signals. The balun provides a balanced load for the antenna. Furthermore, the balun isolates the antenna such that only the antenna radiates. In addition, the resonant frequency of the system is determined by the antenna only, rather than the antenna together with exposed conductors of the link between the antenna and the receiving circuit. This means that the radiating and resonating conductor lengths match, resulting in improved efficiency.

As an alternative, the current choke can be formed by a half balun sleeve. In such an arrangement, only one conductor, for example 116A is used. This has substantially the same effect as a full balun sleeve. A further alternative is to use a ferrite current choke. Ferrite plates are placed on either side of the transmission line in a similar manner to the sleeve balun. An advantage of such an arrangement is that the plates do not have to be a quarter wavelength long, thereby allowing a more compact design. The choke may also be embodied as a coaxial TEM resonator associated with the transmission line, the transmission line preferably being in the form of a coaxial line. Such a resonator may typically be embodied as a quarter-wave open-ended dielectrically-loaded cavity.

What is claimed is:

1. An antenna system for operation at frequencies in excess of 200 MMz, comprising an antenna, a transmission line and a receiver stage, the transmission line electrically connecting the antenna to an input of the receiver stage, and the antenna having:

an antenna core of a solid insulative material having a relative dielectric constant greater than 5, the material of the core occupying the major part of the volume defined by the core outer surface, and a three-dimensional antenna element structure disposed on or adjacent the outer surface of the core; wherein the antenna is fed by the transmission line at a proximal end of the dielectric core, the receiver stage comprises an amplifier and an electromagnetic radiation screen, the amplifier being positioned within the screen, and the transmission line includes a current choke arranged to provide a substantially balanced condition at a feed connection of the antenna.

2. A system according to claim 1, wherein the core has a proximal face and a distal face, the antenna element structure comprises a plurality of elongate conductive elements having end portions on the proximal face, and the transmission line comprises a first conductor electrically connected to one of the end portions, and a second conductor, electrically connected to another of the end portions, the first conductor terminating within the screen.

3. A system according to claim 2, wherein the first conductor is electrically connected within the screen to an input of the amplifier and the second conductor is electrically connected to a ground conductor shared with the amplifier.

4. A system according to any of claims 1 to 3, wherein the current choke is a sleeve balun.

5. A system according to claim 4, wherein the sleeve balun comprises at least one electrically conductive member alongside the said second conductor and having one end connected to the second conductor and an opposite end which is open circuit, the conductive member being approximately one quarter wavelength in electrical length at the operating frequency.

6. A system according to any of claims 1 to 3, wherein the current choke comprises at least one ferrite layer.

7. A system according to any of claims 1 to 3 wherein the transmission line is formed by a planar member, the first conductor being embedded within the planar member and the second conductor being formed on the outer surfaces of the planar member.

8. A system according to claim 1, wherein the choke comprises a resonant element associated with the transmission line, the resonant element being dielectrically loaded with a dielectric element made of a material having a relative dielectric constant which is less than that of the material forming the antenna core.

9. A system according to claim 8, wherein the relative dielectric constant of the said dielectric element is at least 5 times less than that of the antenna core material.

10. A system according to claim 1, wherein the choke comprises a resonant element having at least one planar face.

11. A system according to claim 10, wherein the antenna has a central axis and the planar face of the resonant element is parallel to the axis.

12. A system according to claim 11, wherein the choke comprises a planar resonant element in the form of a conductive film on a laminate board.

13. A system according to any of claims 8 to 12, wherein the choke is spaced from the antenna core and transmission line comprises first and second conductive elements which extend beyond the choke to form a connection with the antenna element structure.

14. A system according to claim 13, wherein the first and second conductive elements extend beyond the choke in a region having surroundings with a relative dielectric constant which is lower than that of the core by a factor of at least 5.

15. A system according to claim 1, wherein the antenna element structure comprises at least one pair of elongate antenna elements, the element of each pair being disposed in an opposing configuration, and wherein the antenna elements have interconnected first ends and have second ends constituting the said feed connection.

16. A system according to claim 15, wherein the core is cylindrical and each antenna element extends between axially spaced-apart positions on the outer surface of the core, and the respective spaced-apart portions of each pair of elements are substantially diametrically opposed.

17. A system according to claim 16, wherein the interconnection is provided by a substantially circular link element which is formed on or adjacent the outer surface of the core.

18. A system according to claim 1, wherein the antenna element structure comprises at least one pair of antenna elements having open-circuit distal ends.

19. A system according to any of claims 15 to 18, wherein the antenna elements are of equal length and are helical, each executing a half-turn around the core between the said spaced-apart positions.

20. A system according to any of claims 1 to 3, wherein the antenna comprises a single pair of antenna elements forming a bifilar helix antenna.

21. The system according to any of claims 1 to 3, wherein the antenna comprises two pairs of antenna elements forming a quadrifilar helix antenna.

22. An antenna system for operation at frequencies in excess of 200 MHz comprising the combination of an antenna, an amplifier stage and a transmission line interconnecting the antenna and the amplifier stage, wherein the antenna comprises a three-dimensional antenna element structure disposed on or adjacent the outer surface of an antenna core, the core being made of a solid electrically insulative material having a relative dielectric constant greater than 5, which material occupies the major part of the volume defined by the core outer surface, wherein the amplifier stage comprises an amplifier circuit within a conductive screen, and wherein the transmission line has a current choke arranged to provide a substantially balanced feed connection at a feed connection of the antenna element structure.

23. A system according to claim 22, wherein the transmission line comprises a first conductor connected at one end to the antenna element structure and at the other end to an input of the amplifier, the connection to the amplifier input being within the screen, and a second conductor providing a conductive path from the antenna element structure to ground, which conductive path extends directly from the antenna element structure at one end of the second conductor to a ground connection adjacent the amplifier input, the ground connection being at the other end of the second conductor, and wherein the choke is located on the outside of the second conductor.

24. A system according to claim 23, wherein the second conductor of the transmission line is a shield for the first conductor, and the choke comprises a third conductor having an electrical length which is substantially a quarter wavelength or an odd multiple of a quarter wavelength at an operating frequency of the system, the third conductor extending alongside the second conductor from a connection with the second conductor to an open circuit end near the antenna.

* * * * *

UNITED STATES PATENT AND TRADEMARK OFFICE

CERTIFICATE OF CORRECTION

PATENT NO. : 7,528,796 B2
APPLICATION NO. : 11/803405
DATED : May 5, 2009
INVENTOR(S) : Oliver Paul Leisten It is certified that error appears in the above-identified patent and that said Letters Patent is hereby corrected as shown below:

Claim 1, Column 7, row 54, please change “MMz” to “MHz”.

Signed and Sealed this

Sixteenth Day of June, 2009

JOHN DOLL
*Acting Director of the United States Patent and Trademark Office*